United States Patent [19]

Elderfield

[11] 4,258,633

[45] Mar. 31, 1981

[54] COOLING OF TUYERES IN BLAST FURNACES

[75] Inventor: Raymond N. Elderfield, Sheffield, England

[73] Assignee: Housley Kimmich Company, Cuyahoga Falls, Ohio

[21] Appl. No.: 21,780

[22] Filed: Mar. 19, 1979

[51] Int. Cl.[3] ..... F23L 5/00; C21B 7/16

[52] U.S. Cl. ..... 110/182.5; 165/105; 266/270

[58] Field of Search ..... 110/182.5; 122/6.6, 122/366; 266/270; 165/105

[56] References Cited

U.S. PATENT DOCUMENTS

| | | | |
|---|---|---|---|
| 2,827,279 | 3/1958 | Cox | 266/270 X |
| 3,493,177 | 2/1970 | Bromberg et al. | 165/105 X |
| 4,169,387 | 10/1979 | Krempl | 165/105 X |

FOREIGN PATENT DOCUMENTS

| | | | |
|---|---|---|---|
| 761336 | 7/1971 | Belgium | 266/270 |

*Primary Examiner*—Charles A. Ruehl

[57] ABSTRACT

A tuyere for use in a blast furnace and provided with or constituted by a number of heat pipes extending generally longitudinally of the tuyere, the heat pipes being connectible to heat transfer apparatus located wholly outside the furnace.

8 Claims, 8 Drawing Figures

COOLING OF TUYERES IN BLAST FURNACES

The invention relates to the cooling of tuyeres in blast furnaces and has for its object to provide an improvement therein. The tuyeres of blast furnaces are nozzles for blasts of air blown into the furnace during its operation to provide the necessary reaction with the coke therein. This generates intense heat for the operation of the furnace.

The tuyeres of blast furnaces are subjected to very severe operating conditions and it is necessary for heat to be transmitted away from them at a very high rate throughout the operation of the furnace. For this reason they are invariably made of copper and in the past it has been commonplace to transfer the heat away by the use of water flowing through passages formed in the walls of the tuyeres. Failure of a tuyere does occur from time to time due to molten metal locally burning through the copper and breaking into one of the passages carrying cooling water. At such a time the flow of cooling water must be immediately shut off and this then results in total destruction of the tuyere. This failure is inconvenient for two reasons. Firstly, large quantities of water in the furnace cause cooling and solidification of the iron therein and oxidation of the carbon refractories. Secondly, the need for frequent interruption of the furnace operation to enable the replacement of the tuyeres to be carried out is both costly and troublesome.

According to one aspect of the invention, there is provided a tuyere for use in a blast furnace, the tuyere being provided with a plurality of heat pipes (that is to say low pressure, boiling/condensing units) extending generally longitudinally of the tuyere between its wall thickness and projecting from an outer end of the tuyere for connection to heat transfer apparatus, or alternatively, the tuyere being constituted by the evaporator (heat input) ends of a plurality of hollow segments each of which constitutes a heat pipe.

According to another aspect of the invention, there is provided a blast furnace with tuyeres which are each provided with a plurality of heat pipes (that is to say low pressure, boiling/condensing units) extending generally longitudinally of the tuyere between its wall thickness and projecting from an outer end of the tuyere and connected to heat transfer apparatus, or alternatively, each tuyere being constituted by a plurality of hollow segments each of which constitutes a heat pipe.

Figure 1:
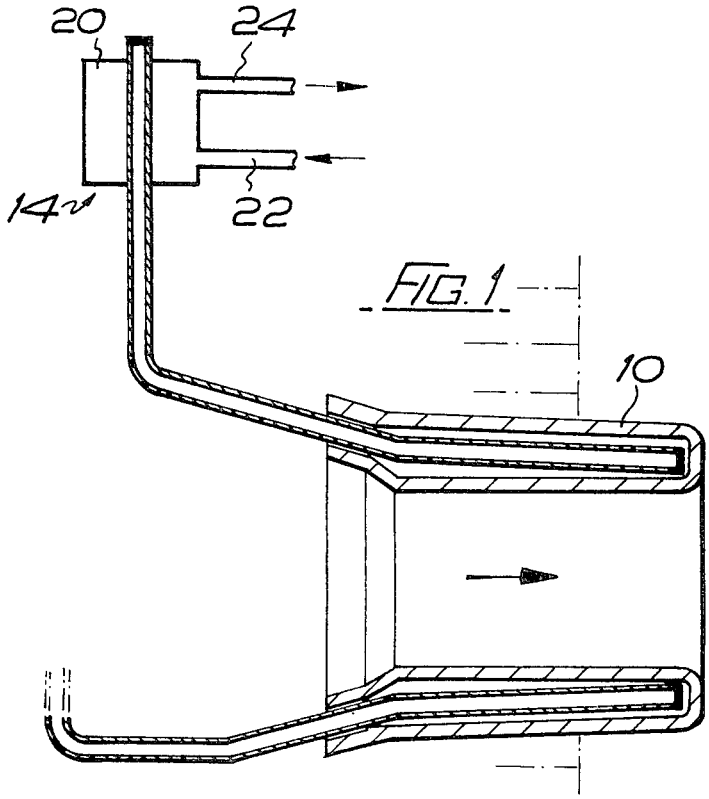
Figure 2:
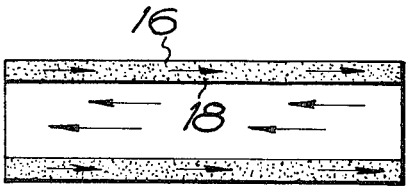
Figure 3:
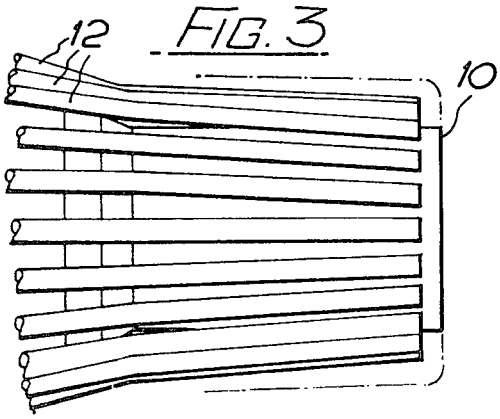
Figure 4:
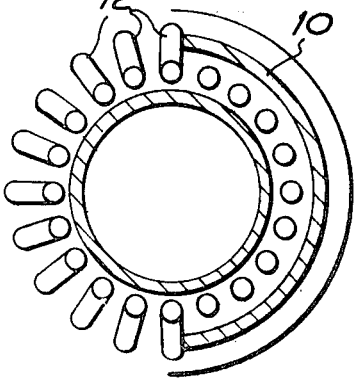
Figure 5:
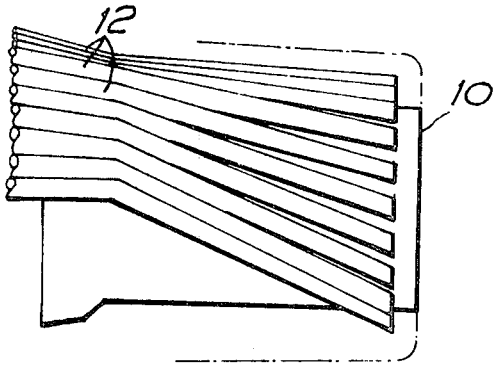
Figure 6:
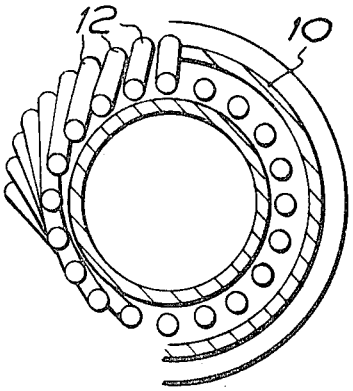
Figure 7:
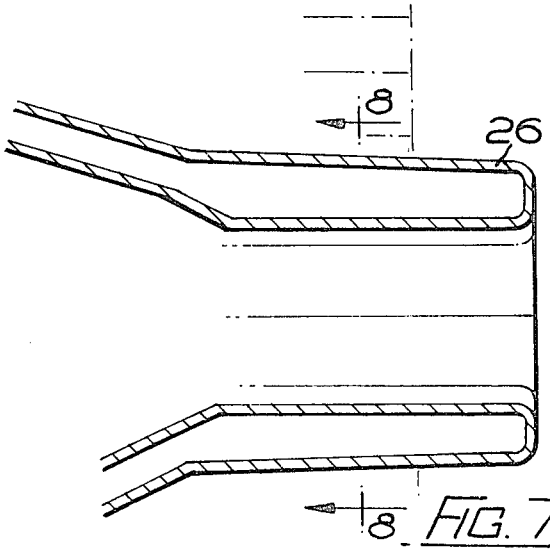
Figure 8:
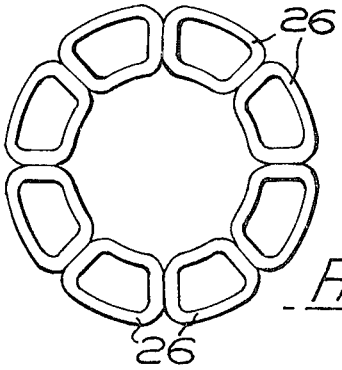

In order that the invention may be fully understood and readily carried into effect, the same will now be described, by way of example only, with reference to the accompanying drawings, of which:

FIG. 1 is a diagrammatic sectional view of a tuyere embodying the invention, FIG. 2 is a diagrammatic illustration of a heat pipe, FIGS. 3 and 4 are diagrammatic side and end views which will presently be referred to, FIGS. 5 and 6 are views similar to FIGS. 3 and 4 which will be referred to when describing a possible modification, FIG. 7 is a longitudinal section through a different construction of tuyere embodying the invention, and FIG. 8 is a sectional view on the line 8—8 in FIG. 7.

Referring now to FIG. 1 of the drawings, the tuyere there illustrated comprises a frusto conical section copper casting 10 provided with a plurality of heat pipes 12 extending generally longitudinally of the tuyere between its wall thickness and projecting from an outer end of the tuyere for connection to heat transfer apparatus generally indicated 14. Only two of the heat pipes are shown in FIG. 1, but it will be understood that the heat pipes are closely spaced around the circumference of the tuyere. The tuyere is shown to extend through the wall of a blast furnace (shown in chain-dotted lines).

Each heat pipe is a sealed, low pressure, boiling/condensing tubular unit utilizing capillary action for condensate return to an evaporator (heat input) section from a condenser (heat removal) section. Such units are commercially available. A heat pipe is illustrated diagrammatically in FIG. 2 and is shown to include a hollow tube 16 with closed ends and a lining material constituting a wick 18. The tube has been evacuated of air and a quantity of a suitable working fluid has been introduced into the tube before it has been sealed. It will be seen that each of the heat pipes in the arrangement illustrated in FIG. 1 requires to be of somewhat dog-leg form so that its condenser (heat removal) section can enter the heat transfer apparatus vertically whereby the working fluid can return to the evaporator (heat input) section assisted by gravity. However, for the sake of diagrammatic illustration the heat pipe in FIG. 2 is shown to be straight.

The heat transfer apparatus 14 includes a heat exchange chamber 20 which surrounds the uppermost portion of at least one of the heat pipes, the chamber 20 being provided with flow and return pipes 22 and 24 for the circulation of cooling water through the chamber. It will be understood that the heat pipes may be associated with respective heat exchange chambers. Alternatively, the heat exchange chamber 20 may be such that the uppermost portions of the heat pipes can be arranged side by side, all of them extending into the heat exchange chamber.

Referring now to FIGS. 3 and 4, these views, which are diagrammatic only, illustrate how the plurality of heat pipes extend generally longitudinally of the tuyere between its wall thickness, the pipes being equally spaced apart both at the front end and at the rear end of the tuyere. However, in FIGS. 5 and 6, which are views similar to FIGS. 3 and 4, there is illustrated a possible modification in which although the heat pipes are equally spaced apart around the front end of the tuyere (that is to say the narrower end which is to extend into a furnace) they are gathered together at the rear end of the tuyere before extending upwards into the heat transfer apparatus. This may be advantageous because it ensures that the evaporator (heat input) sections of all the heat pipes, that is to say even the lowermost ones, are downwardly inclined so that the working fluid can return from the condenser (heat removal) sections assisted by gravity along the entire length of each pipe.

Referring now to FIGS. 7 and 8, in a rather different construction of tuyere, the double-walled frusto-conical body part is constituted by the evaporator (heat input) ends of a plurality of hollow segments 26 abutting together side by side, each of said segments constituting a heat pipe. As in the previously described embodiments, the uppermost portions (not shown) of the heat pipes, that is to say, the condenser (heat removal) sections, will be associated with heat transfer apparatus. The tuyere is again shown extending through the wall of a blast furnace (shown in chain-dotted lines).

Various modifications may be made without departing from the scope of the invention. It will be particularly advantageous if provision is made whereby a failed heat pipe can be removed for replacement by a new heat pipe without the necessity to replace the whole tuyere. In the constructions illustrated in FIG. 1 and in FIGS. 3 to 6, by careful design this can obviously be achieved fairly easily but in the case of the tuyere illustrated in FIGS. 7 and 8 some form of internal and external cladding would be required. In all the embodiments illustrated it will be understood that refractory cladding may be employed to protect the tuyere from damage by sudden high heat fluxes. Although the tuyeres described have been said to be made from copper it will be understood that they could be made from other metals. cm

What I claim and desire to secure by Letters Patent is:

1. A tuyere for use in a blast furnace, formed of spaced apart walls meeting at a nose end of the tuyere which is the end adapted to be located within a furnace, and comprising;

a plurality of heat pipes extending longitudinally of the tuyere body within the space between said walls and having closed ends terminating in the vicinity of said nose end of the tuyere so as to be able to remove heat therefrom, said heat pipes extending, from the closed ends, to a heat exchange location, said heat pipes adapted to convey a low pressure boiling-condensing fluid and having means for conveying the fluid in liquid form towards the said closed ends and, as a gas, within the same pipe, away from said closed ends, All of said pipes including at least one portion inclined downwardly between its heat exchange location and its closed end to facilitate movement of liquid from said heat exchange location towards said closed end.

2. A tuyere according to claim 1, wherein all of said pipes are downwardly inclined throughout their lengths from said heat exchange location to their said closed ends, so as to allow gravity to assist in returning the working fluid toward said closed ends throughout the length of each pipe.

3. A tuyere according to claim 2, the walls of the tuyere body forming an inside space of generally frustro-conical form, the closed ends of said heat pipes being equally spaced around the said inside space near the nose end of the tuyere, and the ends of the heat pipes at said heat exchange location all being clustered together at a height higher than the level of the tuyere.

4. A tuyere according to claim 1 or claim 2, including a heat exchanger means at said heat exchange location for removing heat from said heat pipes.

5. A tuyere according to claim 4, the end of said tuyere opposite from said nose end being opened, and the heat pipes passing through said open end for operative connection to said heat exchanger means at said heat exchange location.

6. A tuyere according to claim 1, the portion of said heat pipes within the said space being constituted by a plurality of hollow segments, each of which constitutes a heat pipe.

7. A blast furnace having tuyeres positioned therein and adapted to act as a nozzle for directing blasts of air into the furnace, said tuyeres having spaced apart walls meeting at a nose end of the tuyere, said nose ends located within the furnace, each tuyere comprising:

a plurality of heat pipes extending longitudinally of the tuyere body within the space between said walls and having closed ends terminating in the vicinity of said nose end of the tuyere so as to be able to remove heat therefrom, said heat pipes extending, from the closed ends, to a heat exchange location, said heat pipes adapted to convey a low pressure boiling-condensing fluid and having means for conveying the fluid in liquid form towards the said closed ends and, as a gas, within the same pipe, away from said closed ends, all of said pipes including at least one portion inclined downwardly between its heat exchange location and its closed end to facilitate movement of liquid from said heat exchange location towards said closed end.

8. A blast furnace according to claim 7, including a heat exchanger means at said heat exchange location for removing heat from said heat pipes, said heat exchanger means being located at a height higher than its respective tuyere.

* * * * *